US005765427A

United States Patent [19]

Codatto

[11] Patent Number: 5,765,427

[45] Date of Patent: Jun. 16, 1998

[54] BENDING PRESS FOR SHEET METAL

[76] Inventor: Antonio Codatto, Via Venezia 21 I-36045, Lonigo (Vicenza), Italy

[21] Appl. No.: 776,438

[22] PCT Filed: Jul. 17, 1995

[86] PCT No.: PCT/EP95/02794

§ 371 Date: Mar. 26, 1997

§ 102(e) Date: Mar. 26, 1997

[87] PCT Pub. No.: WO96/04084

PCT Pub. Date: Feb. 15, 1996

[30] Foreign Application Priority Data

Jul. 29, 1994 [IT] Italy ..... TO94A0635

[51] Int. Cl.[6] ..... B21D 5/04

[52] U.S. Cl. ..... 72/307; 72/313; 72/386; 72/322

[58] Field of Search ..... 72/307, 311–314, 72/322, 386

[56] References Cited

U.S. PATENT DOCUMENTS

| | | | |
|---|---|---|---|
| 3,407,850 | 10/1968 | Kelm | 72/307 |
| 4,043,165 | 8/1977 | Badger | 72/307 |

FOREIGN PATENT DOCUMENTS

| | | | |
|---|---|---|---|
| 490828 | 6/1992 | European Pat. Off. . | |
| 4343123 | 6/1995 | Germany . | |
| 1428491 | 10/1988 | Russian Federation | 72/307 |

*Primary Examiner*—Daniel C. Crane

*Attorney, Agent, or Firm*—Wigman, Cohen, Leitner & Myers, P.C.

[57] ABSTRACT

The press comprises two tool holders facing each other (28*a*, 28*b*), capable of relative movement one towards the other and back again. Each tool holder carries a bending tool (40*a*, 40*b*) and a clamping tool (42*a*, 42*b*). The tool holders (28*a*, 28*b*) are in addition capable of relative movement between two working positions in one of which the rear edge (46*a*) of a tool holder (28*a*) is so positioned as to cooperate, in order to bend the sheet (L) in a first direction, with a front edge (44*b*) of the bending tool (40*b*) of the other tool holder (28*b*), and the clamping tool (42*b*) of the other tool holder (28*b*) is immediately opposite the tool of the first tool holder (28*a*) in order to cooperate with it through the interposed sheet (L). In the other working position, the functions of the edges of the bending tools and the functions of the clamping tools are reversed in order to carry out the bend in the other direction. The clamping tools (42*a*, 42*b*) are mounted in their tool holders in such a way that they retreat against the force of means of elastic repulsion (50*a*, 50*b*).

22 Claims, 3 Drawing Sheets

BENDING PRESS FOR SHEET METAL

This application is a 371 of PCT/EP95/02794, filed Jul. 17, 1995. The present invention relates to a bending press for sheet metal and has been designed for application in the bending of very thick sheet metal, for example 5–10 mm thick, but is not limited to this application.

The principle object of the invention is to produce a versatile bending press of simple design that can carry out bends in one direction or the other, as desired, relative to a plane in which the sheet lies, and that can carry out these bends at any angle within a range from 0° to 90°.

By virtue of this solution to the problem, the press can be selectively set in order to bend the sheet in one direction or the other simply by relatively displacing the tool holders, in the direction of introduction of the sheet, from one working position to the other. The angle of bending can be set simply by adjusting the relative working stroke of the tool holders in the direction normal to the plane in which the sheet lies.

The invention will be understood more clearly from the detailed description which follows of a preferred embodiment of the bending press, which description is given with reference to the appended drawings which are provided by way of nonlimiting example and in which.

Figure 1:
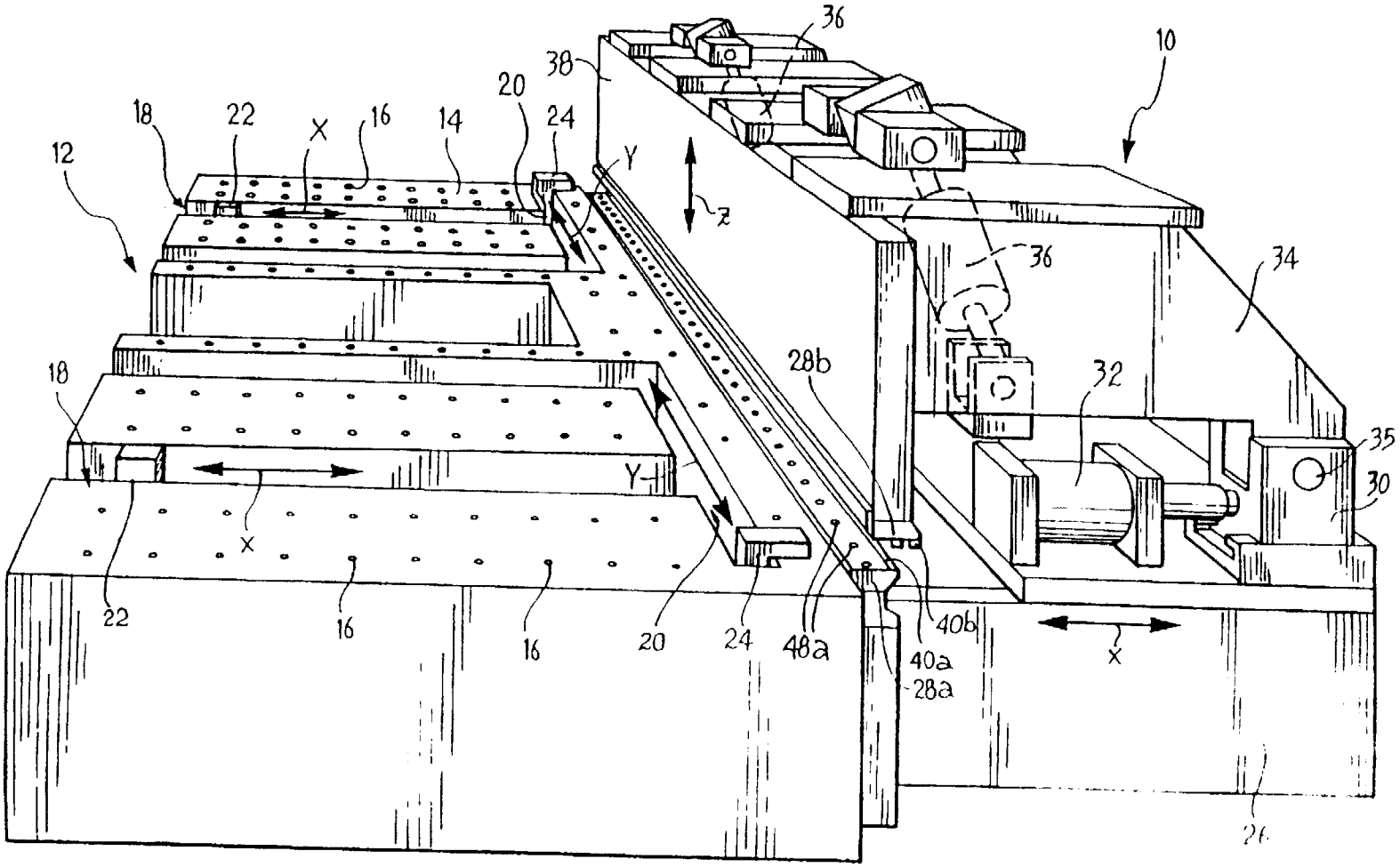
FIG. 1 is a perspective view of the press.

With reference to FIG. 1, a bending press according to the invention is indicated overall by the reference numeral 10.

The press 10 is associated with a table 12 that feeds the sheets to said press.

The table 12 has a horizontal upper support surface 14 of the known type with balls 16. The upper surface 14 is divided up into various parts by longitudinal channels 18 and by a transverse channel 20.

Pushers 22 can move backwards and forwards within the longitudinal channels 18, in the direction of the double arrows X, so as horizontally to feed a sheet to be bent into the press 10 and correctly position it in the place where the bend is to be carried out.

The double arrows X also conventionally indicate the direction of introduction of the sheet to be bent in the press, details of which direction will be discussed below.

Abutment elements 24, that serve to centre the sheets transversely with respect to the press 10, can move towards one another and back again in the transverse channels. The direction of movement of the abutment elements 24 is indicated by the double arrows Y, which also conventionally indicate the direction parallel to the bends to be carried out by the press 10. Details of the direction Y will also be discussed below.

The directions X and Y also define a horizontal plane in which the sheet to be bent lies.

Still with reference to FIG. 1, the press 10 comprises a sturdy base 26 on which a first immovable lower tool holder 28*a* is fixed, which will be described in detail when referring to FIG. 2.

The base 26 carries a slide in the form of clevis pads 30 that slide on the base 26 in the direction X of introduction of the sheet in the press. This direction X is again indicated by a double arrow. Associated with each clevis 30 are means for controlling its movements backwards and forwards in the direction X. Preferably, these control means take the form of hydraulic jacks 32, as illustrated.

A sturdy frame 34 is hinged about horizontal pins 35, which are parallel to the transverse direction Y, in the clevis pads 30 constituting the slide.

Control means, preferably in the form of hydraulic jacks 36, are interposed between the slide 30 and the frame 34.

A sturdy transverse plate 38 is fixed on that side of the frame 34 which faces the table 12 and is opposite the side with the pins 35. On its lower side the plate 38 carries a second movable upper tool holder 28*b* which faces the immovable lower tool holder 28*a*. The upper tool holder 28*b* will be described in greater detail below with reference to FIG. 2.

For now, suffice it to say that the control means 36 are able to cause the tool holder 28*b* to move back and forth in an upward and downward movement, substantially in the vertical direction indicated by the double arrow Z, so as to bend the sheets that are introduced into the press, in conjunction with the immovable lower tool holder 28*a*.

The vertical direction Z is normal to the horizontal plane in which the sheet lies and which is defined by the directions X and Y.

Figure 2:
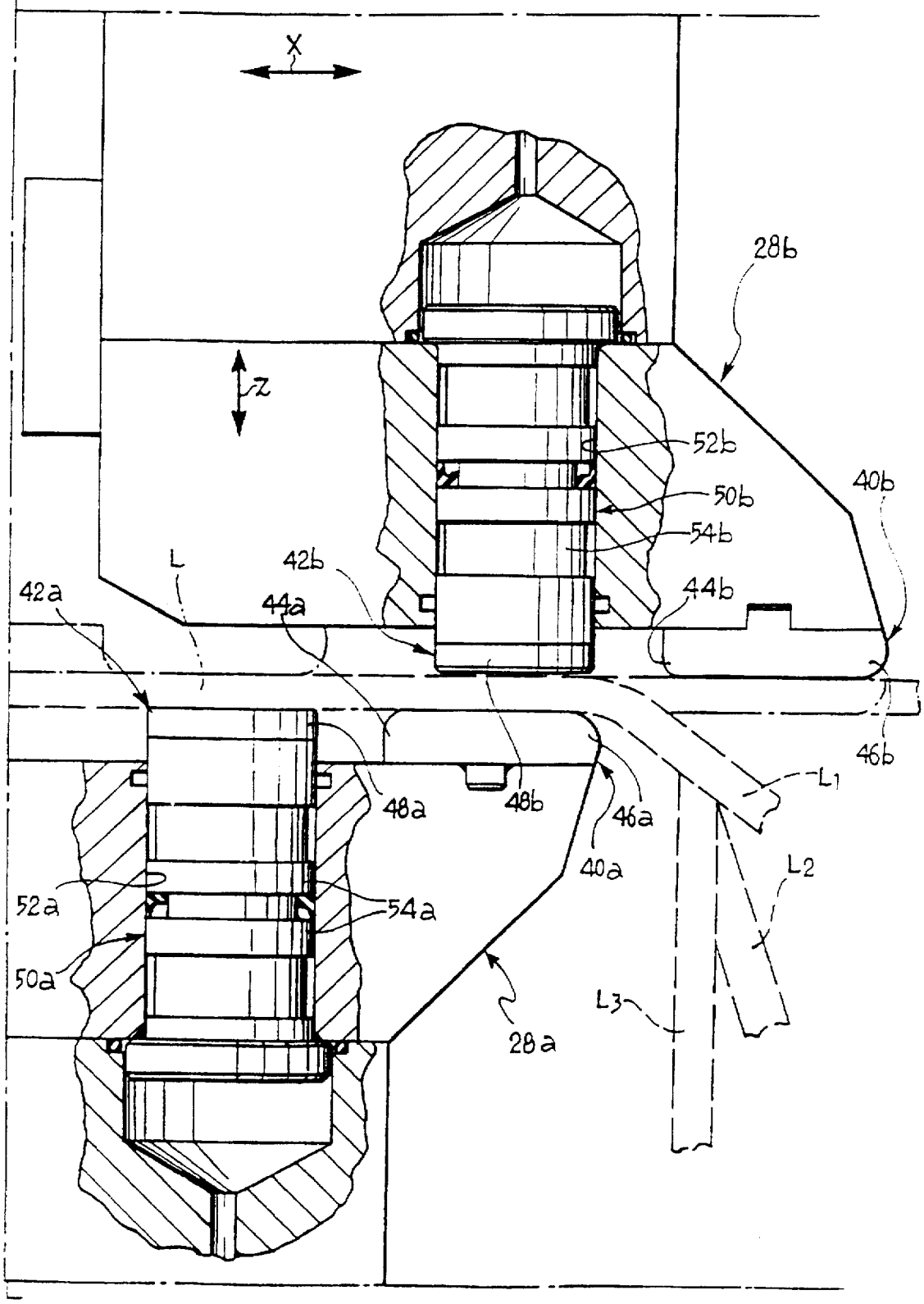
FIG. 2 is a side view thereof on a larger scale and in partial cross-section.

Reference will now be made to FIG. 2, in order to describe various details of the lower 28*a* and upper 28*b* tool holders.

A sheet which is to be bent or is in the course of being bent is illustrated by dashed lines and is indicated by the reference L.

Each lower 28*a* and upper 28*b* tool holder carries a corresponding bending tool 40*a*, 40*b* and a corresponding clamping tool 42*a*, 42*b*. Each bending tool 40*a*, 40*b* is in the form of a tempered steel bar that extends in the transverse direction Y across the entire width of the press and has active edges at the front 44*a*, 44*b* and rear 46*a*, 46*b*, respectively, the terms "front" and "rear" referring to the direction X of introduction of the sheet.

Preferably, as illustrated, the edges 44*a*, 44*b* and 46*a*, 46*b* are rounded in order to facilitate the progressive bending of thick sheets.

Each clamping tool 42*a*, 42*b* is preferably made up, as illustrated, of a series of pads 48*a*, 48*b* evenly distributed across the width of the press 10, i.e. in the transverse direction Y.

The pads 48*a* of the lower tool holder 28*a* are also visible in FIG. 1.

The clamping tools 42*a*, 42*b* formed by the series of pads 48*a*, 48*b* respectively, are mounted in the relevant tool holders 28*a*, 28*b* in such a way that they retreat against the force of means of elastic repulsion.

Preferably, these means of elastic repulsion are in the form of respective hydraulic piston-and-cylinder units 50*a*, 50*b*. In each of these units, the cylinder 52*a*, 52*b* is formed in the relevant tool holder 28*a*, 28*b*, while the piston 54*a*, 54*b* carries the relevant pad 48*a*, 48*b* at one of its projecting ends that faces the opposite tool holder.

Each piston 54*a*, 54*b* is under an opposing hydraulic pressure exerted, through the interposed sheet L, by the bending tool 40*a* or 40*b* immediately opposite it. This concept will be clarified below.

As a result of its being mounted on the pivoting frame 34 secured to the slide 30, which is in turn operated by the jacks 32 (FIG. 1), the upper tool holder 28*b* can be moved in the direction of the arrow X between two working positions which, as will be seen, serve to produce a downward, so-called "negative", bend and an upward, so-called "positive", bend respectively, in a sheet L.

In FIG. 2 the two tool holders 28a, 28b and their bending tools 40a, 40b and clamping tools 42a, 42b are shown in solid lines in the position which corresponds to a "negative" bend.

The sheet L is gripped between the lower bending tool 40a and the upper clamping tool 42b. The upper bending tool 40b is in a retracted position (towards the inside of the press) with respect to the lower bending tool 40a. This position is such as to cause the front active edge 44b of the upper tool 40b to cooperate with the rear active edge 46a of the lower tool 40a during the bending operation.

The sheet L simply rests on the clamping tool 42a, above which there is no bending tool.

In order to carry out a "negative" bend, a programmer or other control system, by controlling the relevant jacks 36, causes the upper tool holder 28b to execute reciprocating strokes of increasing amplitude so as to produce the bend in a succession of strokes.

Thus, in the outward movement of a first reciprocating stroke, the sheet is bent through a certain angle according to the configuration indicated by $L_1$; in the outward movement of a second reciprocating stroke, the sheet is bent through a greater angle, according to the configuration indicated by $L_2$; in the outward movement of a final reciprocating stroke, the sheet is bent through an angle of 90° according to the configuration indicated by $L_3$.

As will be understood, by programming the number and amplitude of the reciprocating working strokes (for example by employing a digital control system), it is possible to produce any desired angle of bending, the angle of the bend being proportional to the number and amplitude of the successive reciprocating strokes.

As will also be understood, on each downward stroke of the upper tool holder 28b, the upper sheet-clamping tool 42b retreats elastically, by virtue of the fact that the pistons 54b can withdraw back into the cylinders 52b, whilst still maintaining, by virtue of the hydraulic pressure, the mechanical pressure which grips the sheet L between the pads 48b and the lower bending tool 40a.

The sequence of operations for bending the sheet downwards or "inversely" is more clearly illustrated in FIGS. 3a, 3b, 3c, 3d, 3e and 3f.

Figure 3A:
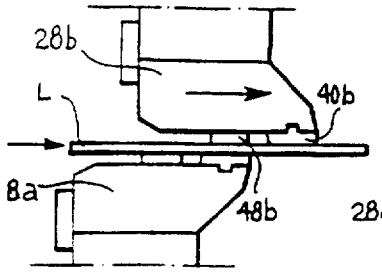
FIGS. 3*a*, 3*b*, 3*c*, 3*d*, 3*e* and 3*f* are side views on a reduced scale showing successive stages in a so-called "negative" bending operation.

In FIG. 3a, the upper tool holder 28b has been set in the position corresponding to this type of bending and illustrated in solid lines in FIG. 2.

Figure 3B:
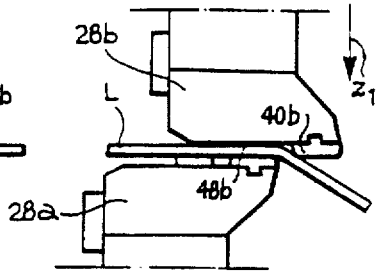

In FIG. 3b, the upper tool holder 28b executes a first downward movement in the direction of the arrow $Z_1$ so as to bend the sheet L through a first angle.

Figure 3C:
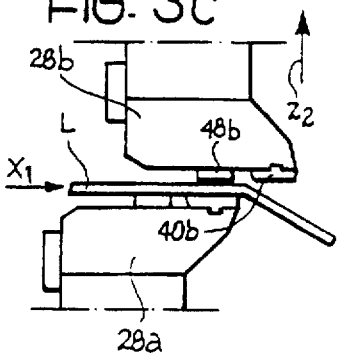

In FIG. 3c, the upper tool holder 28b is raised in the direction of the arrow $Z_2$ until the pads 48b is no longer in contact with the sheet L; the sheet is then made to advance a short distance in the direction of the arrow $X_1$ with a view to continuing the bending according to a curved configuration.

Figure 3D:
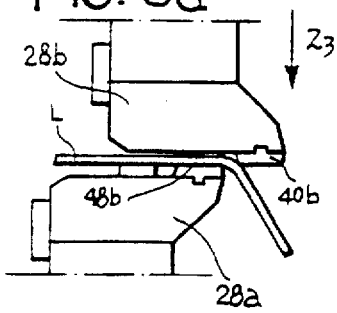

In FIG. 3d, the upper tool holder 28b is lowered once again in a second working stroke in the direction of the arrow $Z_3$ in order to continue the bending.

Figure 3E:
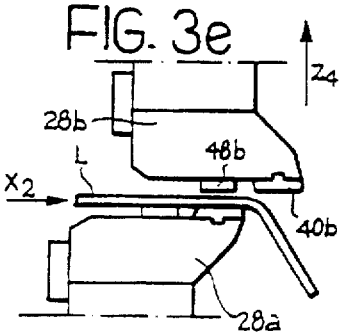

In FIG. 3e, the upper tool holder 28b is raised once again in the direction of the arrow $Z_4$ and the sheet L is made to advance a short distance once again in the direction of the arrow $X_2$ with a view to completing a 90°-bend.

Figure 3F:
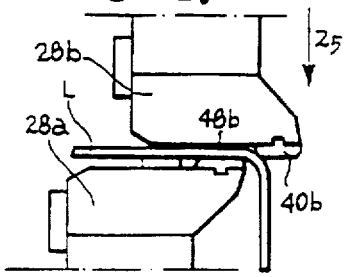

In FIG. 3f, the upper tool holder 28b is lowered for a third time in the direction of the arrow $Z_5$ in order to complete the 90°-bend in the sheet L.

In order to carry out an upward or "positive" bend in the sheet L, the upper tool holder 28b is brought, via the jacks 32, into the other working position, partially illustrated in dot-and-dashed lines in FIG. 2.

In this other working position the functions of the edges of the bending tools and the functions of the clamping tools are reversed: the sheet L is gripped between the upper bending tool 40b and the lower clamping tool 42a; the bending is carried out between the rear edge 46b of the upper bending tool 40b and the front edge 44a of the lower bending tool 40a; on each downward stroke of the upper tool holder 28b, the lower clamping tool 42a retreats elastically under the thrust of the upper bending tool 40b, whilst still maintaining the mechanical pressure which grips the sheet L between the two tools; the upper clamping tool 42b, which in this particular situation is found to the left (in FIG. 2) of the lower clamping tool 42a, i.e. close to the table 12 of FIG. 1, simply retreats, withdrawing into the tool holder 28b without deforming that part of the sheet between the support surface 14 of FIG. 1 and the lower clamping tool 42a.

The sequence of operations for bending the sheet upwards or "positively" is more clearly illustrated in FIGS. 4a, 4b, 4c, 4d, 4e and 4f.

Figure 4A:
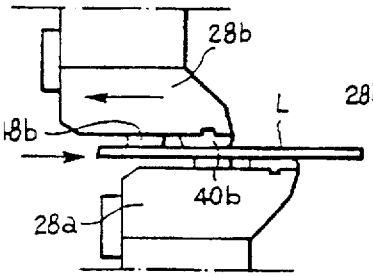
FIGS. 4*a*, 4*b*, 4*c*, 4*d*, 4*e* and 4*f* are views similar to the preceding ones, showing successive stages in a so-called "positive" bending operation.

In FIG. 4a, the upper tool holder 28b has been set in the position corresponding to this type of bending and illustrated in dashed lines in FIG. 2.

Figure 4B:
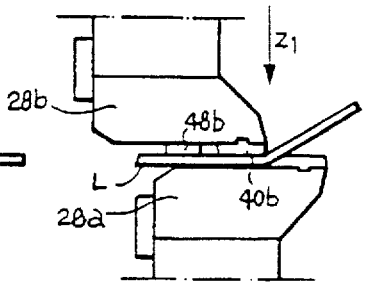

In FIG. 4b, the upper tool holder 28b executes a first downward movement in the direction of the arrow $Z_1$ so as to bend the sheet L through a first angle.

Figure 4C:
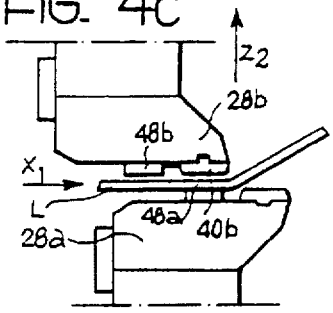

In FIG. 4c, the upper tool holder 28b is raised in the direction of the arrow $Z_2$ until the upper tools 40b and pads 48b are no longer in contact with the sheet L; the sheet L is then made to advance a short distance in the direction of the arrow $X_1$ with a view to continuing the bending according to a curved configuration.

Figure 4D:
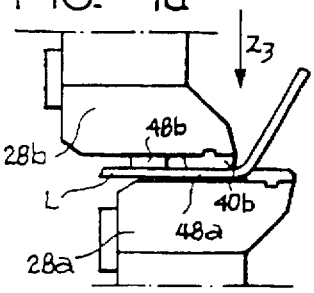

In FIG. 4d, the upper tool holder 28b is lowered once again in a second working stroke in the direction of the arrow $Z_3$ in order to continue the bending.

Figure 4E:
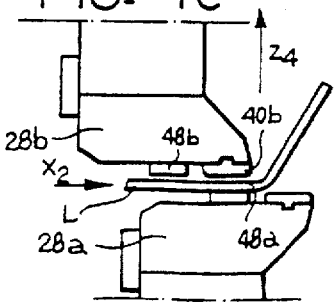

In FIG. 4e, the upper tool holder 28b is raised once again in the direction of the arrow $Z_4$ and the sheet L is made to advance a short distance once again in the direction of the arrow $X_2$ with a view to completing a 90°-bend.

Figure 4F:
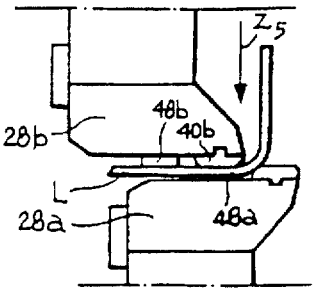

In FIG. 4f, the upper tool holder 28b is lowered for a third time in the direction of the arrow $Z_5$ in order to complete the 90° -bend in the sheet L.

The detailed description given above and with reference to the drawings refers to a preferred embodiment of the bending press according to the invention in which the plane in which the sheet lies is horizontal and the direction normal to this plane is approximately vertical, and in which the press comprises an upper tool holder which can move both vertically, in order to carry out the bending strokes, and horizontally, in order to pass from an upward bending action to a downward bending action, whilst the lower tool holder is immovable.

Naturally, the invention extends to any press of the type claimed in which the aforesaid plane in which the sheet lies is not horizontal and the direction normal to this plane is not approximately vertical. Similarly, either of the tool holders could be movable whilst the other is immovable or, alternatively, both tool holders could be capable of relative movement; either of the two tool holders could be displaceable between the two working positions in order to bend the sheet in one direction or the other, and either of the tool holders could execute the bending stroke.

I claim:

1. Bending press for sheet metal, especially thick sheet metal, of the type that comprises a first and a second tool holder facing each other, capable of relative movement one toward the other and back again in a direction normal to the plane in which the sheet to be bent lies, and bending tools and clamping tools extending parallel to the bend that is to be made and transversely to a direction in which the sheet to be bent is introduced into the press, wherein each tool holder carries a bending tool and a clamping tool of which, with reference to the direction of introduction of the sheet, the bending tool is situated towards the rear and the clamping tool is situated towards the front, in that each bending tool is in the form of a bar that has active edges at the front and rear with reference to the aforesaid direction of introduction of the sheet, in that the tool holders are capable of relative movement, in the direction of introduction of the sheet between two working positions in one of which the rear edge of the bending tool of the first holder is so positioned as to cooperate, in order to bend the sheet in a first direction, with the front edge of the bending tool of the second holder and the clamping tool of the second tool holder is immediately opposite the bending tool of the first tool holder in order to cooperate with it through the interposed sheet in the execution of the bending the first direction, and in the other of which positions the front edge of the bending tool of the first tool holder is so positioned as to cooperate, in order to bend the sheet in the opposite direction to the first direction, with the rear edge of the bending tool of the second tool holder and the clamping tool of the first tool holder is immediately opposite the bending tool of the second tool holder in order to cooperate with it through the interposed sheet in the execution of the bend in the second direction, and in that each clamping tool is mounted in its tool holder in such a way that it retreats against the force of means of elastic repulsion under the mechanical pressure exerted on it, through the interposed sheet, by the bending tool immediately opposite it.

2. Bending press according to claim 1, wherein the active edges of the bending tools are rounded.

3. Bending press according to claim 1, wherein each clamping tool is in the form of a series of pads which extends in the direction of extension of the bar forming the bending tool with which said clamping tool is to cooperate, and in that the means of repulsion of each clamping tool consist of hydraulic piston-and-cylinder units in which the cylinders are formed within their respective tool holders and in which the pistons carry the pads, each piston being under a hydraulic pressure that opposes the mechanical pressure of the bending tool immediately opposite it.

4. Bending press according to claim 1, comprising means for bringing about the respective movements of the two tool holders, which are so programmed as to execute these respective movements in the form of reciprocating strokes of increasing amplitude so as to produce a bend progressively in a succession of strokes, the angle of the bend being proportional to the number and amplitude of the successive reciprocating strokes.

5. Bending press according to claim 1, comprising one of the tool holders is movable in the direction normal to the plane in which the sheet lies and the other tool holder is immovable in this direction.

6. Bending press according to claim 1, comprising one of the tool holders is movable in the direction in which the sheet is introduced and the other tool holder is immovable in this direction.

7. Bending press according to claim 1, comprising said direction normal to the plane in which the sheet lies is substantially vertical, the first tool holder is the lower tool holder and the second tool holder the upper, in that the upper tool holder is movable in both the direction normal to the plane in which the sheet lies and the direction in which the sheet is introduced, and in that the lower tool holder is immovable.

8. Bending press according to claim 7, comprising a base on which the lower tool holder is fixed, a slide capable of horizontal movement on the base, in the direction in which the sheet is introduced, between the two abovementioned working positions, first operating means interposed between the base and the slide to move the slide between its two working positions, a movable frame carried by the slide, which carries in turn the upper tool holder and is movable back and forth, to bring about bending, in such a way as to cause the upper tool holder to execute an approximately vertical reciprocating working movement, and second operating means interposed between the slide and the frame to cause the frame and the upper tool holder to execute the substantially vertical reciprocating working movement.

9. Bending press according to claim 8, wherein the frame is hinged on the slide about a horizontal axis so as to pivot through an angle during the abovementioned reciprocating working movement.

10. Bending press according to claim 2, wherein each clamping tool is in the form of a series of pads which extends in the direction of extension of the bar forming the bending tool with which said clamping tool is to cooperate, and in that the means of repulsion of each clamping tool consist of hydraulic piston-and-cylinder units in which the cylinders are formed within their respective tool holders and in which the pistons carry the pads, each piston, being under a hydraulic pressure that opposes the mechanical pressure of the bending tool immediately opposite it.

11. Bending press according to claim 2, comprising means for bringing about the respective movements of the two tool holders, which are so programmed as to execute these respective movements in the form of reciprocating strokes.

12. Bending press according to claim 3, comprising means for bringing about the respective movements of the two tool holders, which are so programmed as to execute these respective movements in the form of reciprocating strokes.

13. Bending press according to claim 2, wherein one of the tool holders is movable in the direction normal to the plane in which the sheet lies and the other tool holder is immovable in this direction.

14. Bending press according to claim 3, comprising one of the tool holders is movable in the direction normal to the plane in which the sheet lies and the other tool holder is immovable in this direction.

15. Bending press according to claim 4, wherein one of the tool holders is movable in the direction normal to the plane in which the sheet lies and the other tool holder is immovable in this direction.

16. Bending press according to claim 2, wherein one of the tool holders is movable in the direction in which the sheet is introduced and the other tool holder is immovable in this direction.

17. Bending press according to claim 3, wherein one of the tool holders is movable in the direction in which the sheet is introduced and the other tool holder is immovable in this direction.

18. Bending press according to claim 4, wherein one of the tool holders is movable in the direction in which the sheet is introduced and the other tool holder is immovable in this direction.

19. Bending press according to claim 5, wherein one of the tool holders is movable in the direction in which the sheet is introduced and the other tool holder is immovable in this direction.

20. Bending press according to claim 2, wherein said direction normal to the plane in which the sheet lies is substantially vertical, the first tool holder is the lower tool holder and the second tool holder the upper, in that the upper tool holder is movable in both the direction normal to the plane in which the sheet lies and the direction in which the sheet is introduced, and in that the lower tool holder is immovable.

21. Bending press according to claim 3, wherein said direction normal to the plane in which the sheet lies is substantially vertical, the first tool holder is the lower tool holder and the second tool holder the upper, in that the upper tool holder is movable in both the direction normal to the plane in which the sheet lies and the direction in which the sheet is introduced, and in that the lower tool holder is immovable.

22. Bending press according to claim 4, wherein said direction normal to the plane in which the sheet lies is substantially vertical, the first tool holder is the lower tool holder and the second tool holder the upper, in that the upper tool holder is movable in both the direction normal to the plane in which the sheet lies and the direction in which the sheet is introduced, and in that the lower tool holder is immovable.

* * * * *